US006595848B1

(12) United States Patent
Robinson

(10) Patent No.: US 6,595,848 B1
(45) Date of Patent: Jul. 22, 2003

(54) STATIC AIR MIXING APPARATUS

(75) Inventor: Keith D. Robinson, Lakewood, CO (US)

(73) Assignee: Blender Products, Inc., Denver, CO (US)

( * ) Notice: Subject to any disclaimer, the term of this patent is extended or adjusted under 35 U.S.C. 154(b) by 0 days.

(21) Appl. No.: 10/189,705

(22) Filed: Jul. 3, 2002

(51) Int. Cl.[7] ..... F24F 13/04
(52) U.S. Cl. ..... 454/261; 454/269
(58) Field of Search ..... 454/261, 262, 454/265, 266, 267, 264

(56) References Cited

U.S. PATENT DOCUMENTS

| | | | | |
|---|---|---|---|---|
| 3,180,245 | A | 4/1965 | Erickson, Jr. et al. | 454/269 |
| 4,495,858 | A | 1/1985 | Erickson | |
| 5,127,878 | A | 7/1992 | Meckler et al. | 454/269 |
| 5,364,305 | A | 11/1994 | Zieve | 454/261 |
| 5,536,207 | A | 7/1996 | Robinson et al. | 454/261 |
| 5,645,481 | A | 7/1997 | Robinson et al. | 454/261 |

FOREIGN PATENT DOCUMENTS

| | | | |
|---|---|---|---|
| RU | 531000 | 10/1976 | 454/261 |
| RU | 2005282 | 12/1993 | 454/261 |

*Primary Examiner*—Harold Joyce
(74) *Attorney, Agent, or Firm*—Sheridan Ross P.C.

(57) ABSTRACT

A fixed blade air mixing apparatus includes a plurality of radially extending vanes which extend away from a common center and terminate at their outer ends within a polygonal shaped enclosure. The plurality of vanes include an inner section which is curved or pitched in one direction, and an outer section which is curved or pitched in a second direction away from the inner section, the inner and outer sections sharing a common leading edge. The apparatus is intended for use in eliminating stratification of airstreams of different temperatures flowing through a common passage, for example, in heating, air conditioning, or other ventilating ducts. The vanes are designed to establish downstream turbulence of the airstreams passing therethrough which produces optimum mixing effectiveness and a uniform velocity profile of the air downstream of the mixing apparatus with a minimum pressure drop as the air flows through the apparatus.

21 Claims, 4 Drawing Sheets

STATIC AIR MIXING APPARATUS

TECHNICAL FIELD

This invention relates to heating, ventilating and air conditioning systems, and more particularly, to an air mixing apparatus of simplified construction which still achieves adequate mixing efficiency while maintaining a uniform velocity profile and minimum pressure drop.

BACKGROUND OF THE INVENTION

Air streams which are introduced at different temperature levels through a common duct in heating, ventilating and air conditioning (HVAC) systems require intimate mixing in the duct in order to avoid undesirable stratification of air prior to passage of the airstream into a room airspace to be heated or cooled. Failure to achieve intimate mixing in the duct ultimately results in inefficient heating and cooling of the room air space and therefore can significantly affect the cost in operating and maintaining an HVAC system.

A number of prior art references exist which disclose various static air mixing devices. The assignee of the current invention is the owner of a number of previous patents to include U.S. Pat. Nos. 3,180,245; 4,495,858; 5,645,481; and 5,536,207. Each of these references are hereby incorporated by reference for teaching the basic air mixing apparatuses disclosed therein.

An air mixing device installed in an air duct inherently creates a pressure drop in the airflow across the air mixer during operation. This pressure drop is undesirable and therefore, efforts to minimize pressure drop is a main consideration in static air mixing design. Of course, it is also desirable to maximize the efficiency of the mixing that takes place immediately downstream of the mixing apparatus as well as to maintain a uniform velocity profile downstream of the mixing device.

Earlier mixer designs typically had mixing efficiencies of around 30%. In later mixer designs, mixing effectiveness has been greatly improved, and it is not uncommon to find mixers with efficiencies of around 50 or 60%. With the optimized construction of the air mixers disclosed in the U.S. Pat. Nos. 5,645,481 and 5,536,207, air mixing effectiveness of at least 65% was achieved.

Although mixing efficiency has improved due to newer mixer designs, one drawback from some of the newer mixer designs is the complexity of the air mixers, and the cost to manufacture such units.

Therefore, there is a need for development of yet a different mixer design which still achieves acceptable mixer effectiveness, but is of a simpler design which reduces manufacturing costs and makes the mixer more available for all types of commercial use.

SUMMARY OF THE INVENTION

It is therefore an object of the present invention to provide an improved static air mixing apparatus which still achieves acceptable mixing effectiveness; however, the design of the mixer is simplified to reduce manufacturing costs.

Other objects of the invention include, but are not limited to, providing a static air mixing apparatus which still maintains a minimum pressure drop, yet is able to maintain a uniform downstream velocity profile.

In accordance with the present invention, a static air mixing apparatus is provided which meets the aforementioned needs. As with the previous static air mixing apparatuses of the assignee, the current static air mixing apparatus is installed within a duct wherein an enclosure partially traverses the duct defining a core area therein. A plurality of radially extending curved vanes are centered within the enclosure, and the vanes diverge away from a center of the enclosure and terminate at their outer distal ends at or adjacent to the inner wall of the enclosure. The vanes can be defined as including an inner section wherein the vane curves downstream in a first direction, and an outer section which lies radially outward from the inner section; however, the outer section curves downstream in a second direction away from the first section. An interface can be defined as the location at which the distal end of the inner section abuts the proximal end of the outer section. At this interface, the vane is split into its oppositely arranged curved sections.

It is also contemplated within the current invention that yet another section of the vane can be provided which is curved in yet a third direction downstream, different than first and second directions of the inner and outer sections.

Although each vane has been defined as having an inner and outer section, the invention can also be thought of as including a plurality of inner vanes and outer vanes wherein an inner vane and a corresponding outer vane share a common leading edge, but have divergent trailing edges.

In comparison to the apparatuses disclosed in U.S. Pat. Nos. 5,645,481 and 5,136,207, the air mixer of the present invention has slightly less mixing efficiency; however, the construction of the present invention is greatly simplified which reduces manufacturing costs. Furthermore, the mixing method of the present invention greatly differs from the previous inventions of the assignee as further explained below. A comparison of the turbulence created by the present mixer design clearly shows the structural differences in the present invention also results in different air mixing dynamics.

The above and other objects of the present invention will become more readily appreciated and understood from a consideration of the following detailed description of the preferred form of the present invention when taken together with the accompanying drawings.

DETAILED DESCRIPTION

Figure 1:
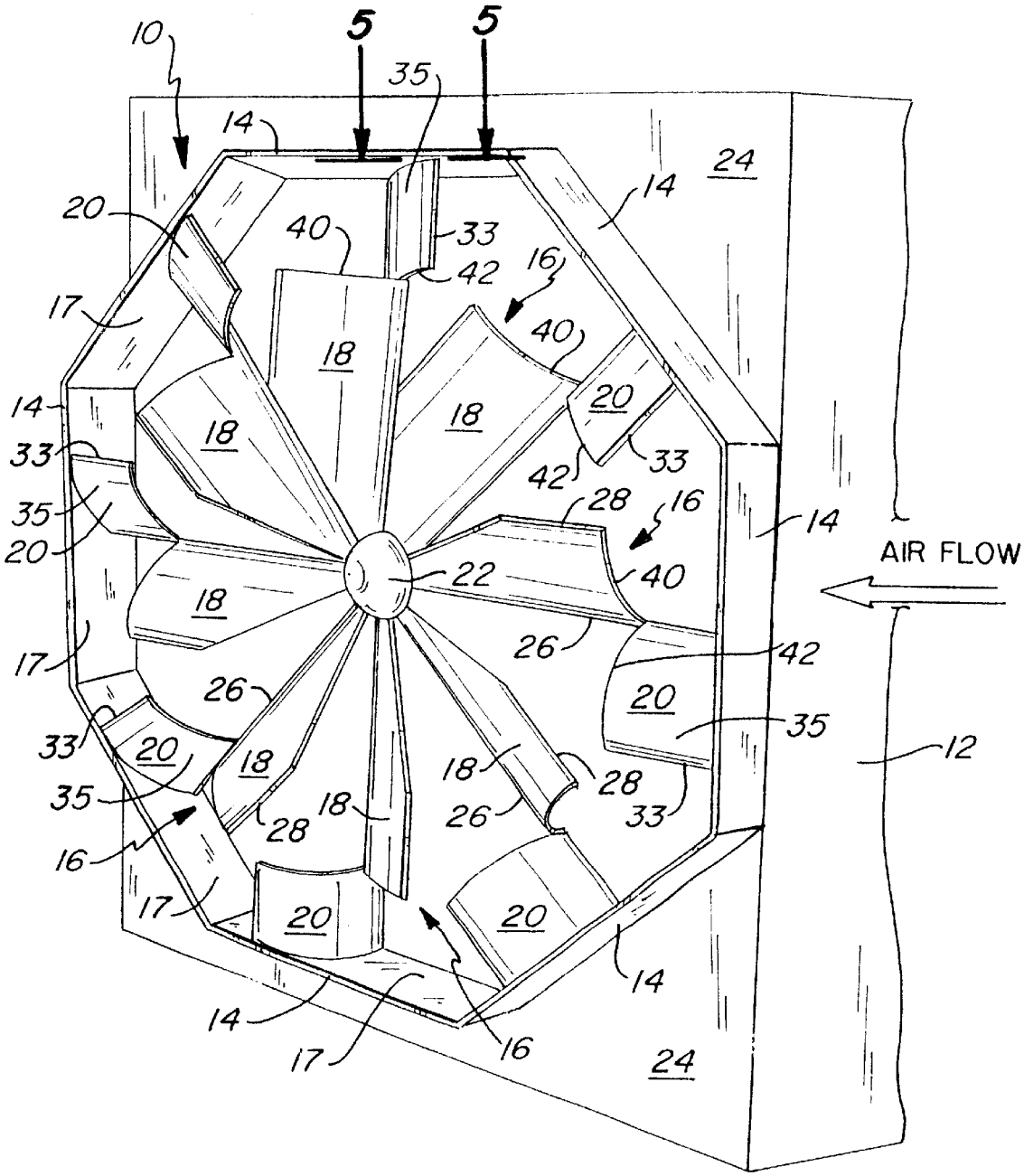
FIG. 1 is a perspective view of the air mixing apparatus of the present invention which is installed within a duct, relevant portions of the duct walls being broken away in order to fully view the air mixing apparatus, and FIG. 1 being a rear view of the air mixing apparatus taken downstream of the air mixing apparatus.
Figure 2:
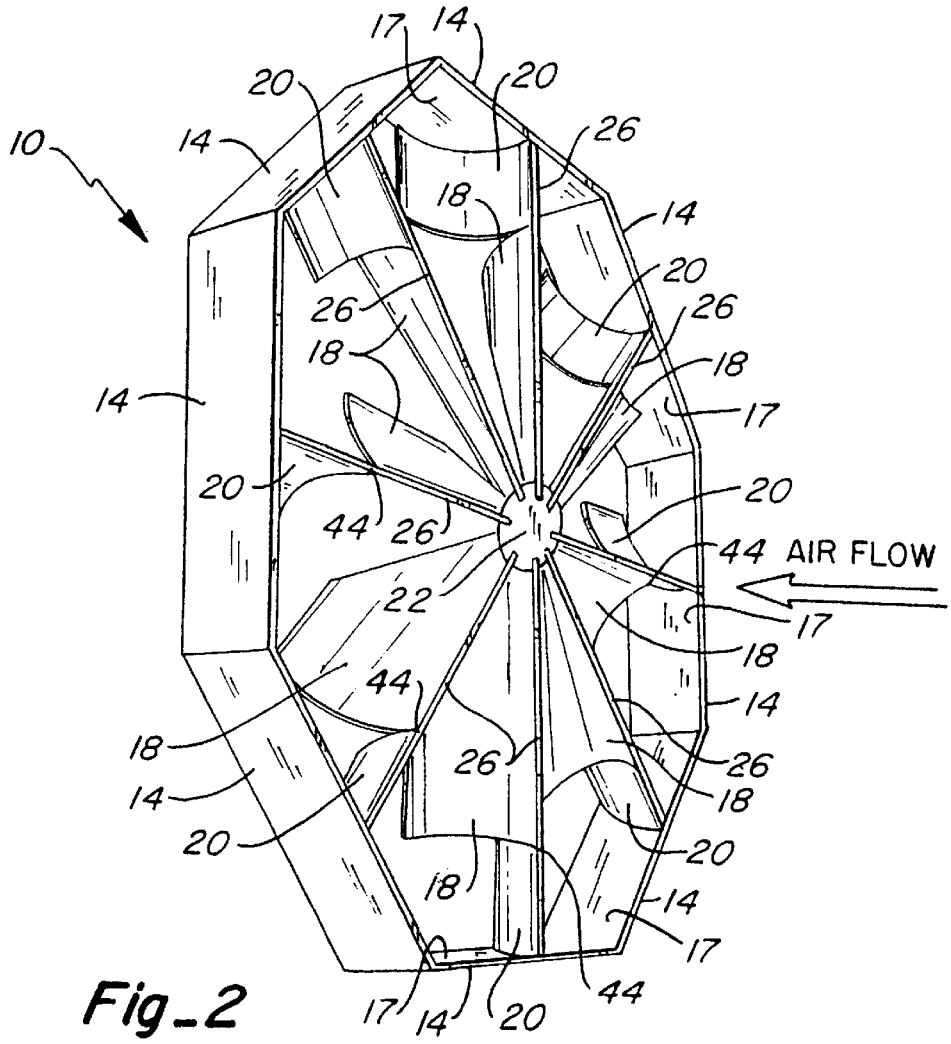
FIG. 2 is a perspective view of the air mixing apparatus taken upstream of the air mixing apparatus, and removed from the duct.

FIGS. 1 and 2 illustrate the static air mixing apparatus of the current invention, shown as mixing apparatus 10. The apparatus includes an enclosure 14 which is mounted within and partially traverses a duct 12. The air mixing apparatus 10 is a static device which has no moving parts. Preferably, the enclosure 14 has an octagonal shape including eight corresponding rectangular panel portions joined in an end-to-end relation to one another. The enclosure 14 carries a plurality of radially extending vanes or blades 16 which diverge away from a center of the enclosure, and terminate at their outer distal ends at the inner wall surface 17 of the enclosure 14. Preferably, the vanes 16 are uniformly spaced from one another, and each of the vanes includes an inner section 18 and a corresponding outer section 20 which shares a common leading edge with the inner section 18. The inner sections 18 of the vanes are preferably curved in the same downstream direction to impart either a clockwise or counterclockwise rotation to air passing through the mixing apparatus 10. Similarly, the outer sections 20 of the vane also are curved, but at a different angle in the downstream direction to impart either a clockwise or counterclockwise rotation to air passing therethrough. As further discussed below, the particular vane arrangement shown in FIGS. 1 and 2 provide a particular vortice pattern resulting in efficient mixing of airstreams, yet the design of the present mixer is simplified to reduce manufacturing costs.

Although each of the vanes shown in FIG. 1 have an inner and outer section, it is contemplated within the spirit and scope of this invention that the vanes having an inner and outer section could be dispersed among inner vanes of the type shown in the assignees previous inventions. Thus, a composite pattern of vanes could be provided.

In order to provide a flow of the airstreams through the air mixing apparatus, power is supplied by an upstream fan system or downstream fan system (not shown). The vanes 16 within the enclosure 14 are preferably joined together at a central hub 22. Alternatively, the vanes may be spot welded together at the center of the enclosure, or they may be entirely cantilever supported from the inner wall surfaces 17 of the enclosure 14.

The enclosure 14 is supported in the duct 12 by a support plate 24 transversely mounted in the duct 12 so that all air passing through the duct 12 must pass through the air mixing apparatus 10.

FIG. 2 illustrates the air mixing apparatus removed from the duct. As shown in FIGS. 1 and 2, the enclosure 14 comprises the octagonally arranged panels which may be made from a flat strip of rectangular sheet material, such as sheet metal used in air conditioning duct work folded to create the eight-sided arrangement. As understood by those skilled in the art, the octagonal enclosure could also be made of other acceptable material to include other types of sheet stock. Furthermnore, it should be understood that the shape of the enclosure 14 could be hexagonal, circular, or any other polygonal shape which surrounds the plurality of vanes.

The inner sections 18 of the vanes extend radially outward in a straight line towards the enclosure 14 from the central hub 22 positioned at the center of the enclosure. In the embodiment shown in FIGS. 1 and 2, eight vanes are provided; however, it shall be understood that the number of vanes can also be modified to provide the desired air mixing result. As further discussed below with respect to FIG. 6, the inner sections 18 include a leading edge 26, a trailing edge 28, and a curved portion 29 interconnecting the leading and trailing edges. The proximal or inner end of outer section 20 is shown as proximal end 42. Similarly, the outer sections 20 include the common leading edge 26, a trailing edge 33, and a curved portion 35 interconnecting the leading and trailing edges. The distal or most outer end of inner section 18 is defined by distal end 40.

Figure 3:
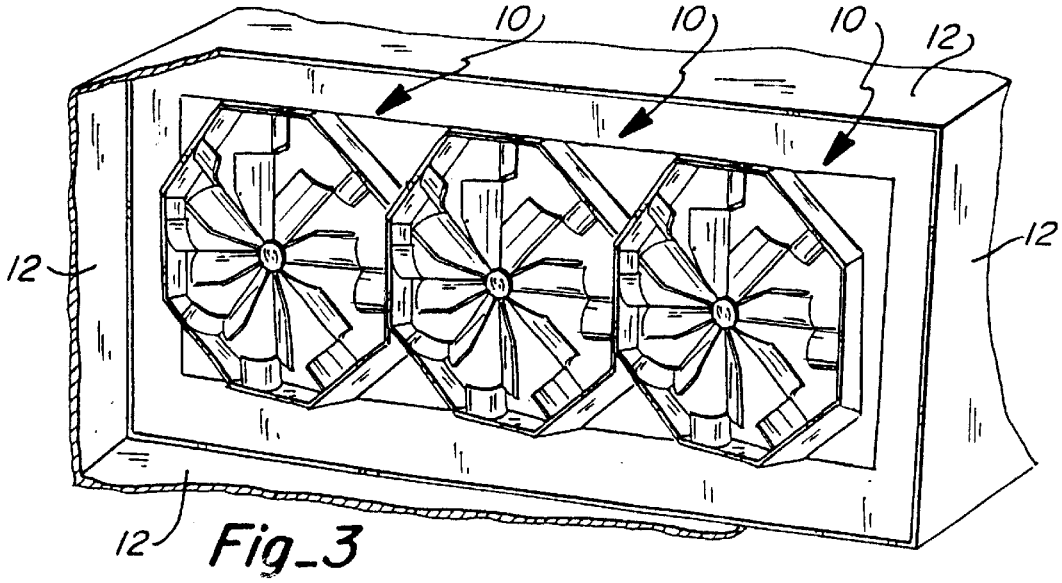
FIG. 3 is a perspective view of a duct having a rectangular cross section with portions broken away to reveal a series of three air mixers disposed in a side by side relation, thus illustrating one arrangement in which more than one air mixing apparatus of the present invention can be enclosed within a duct of a particular size or shape.

FIG. 3 illustrates one manner in which a plurality of air mixing apparatuses 10 may be arranged within a particular shape and sized air duct 12. As shown, three air mixing apparatuses 10 are disposed adjacent to one another within a rectangular shaped duct 12. It will be appreciated that the air mixing apparatuses of the invention can be arranged in other side-by-side arrangements to fit the particular shape of a duct in which mixing of airstreams is desired.

Figure 4:
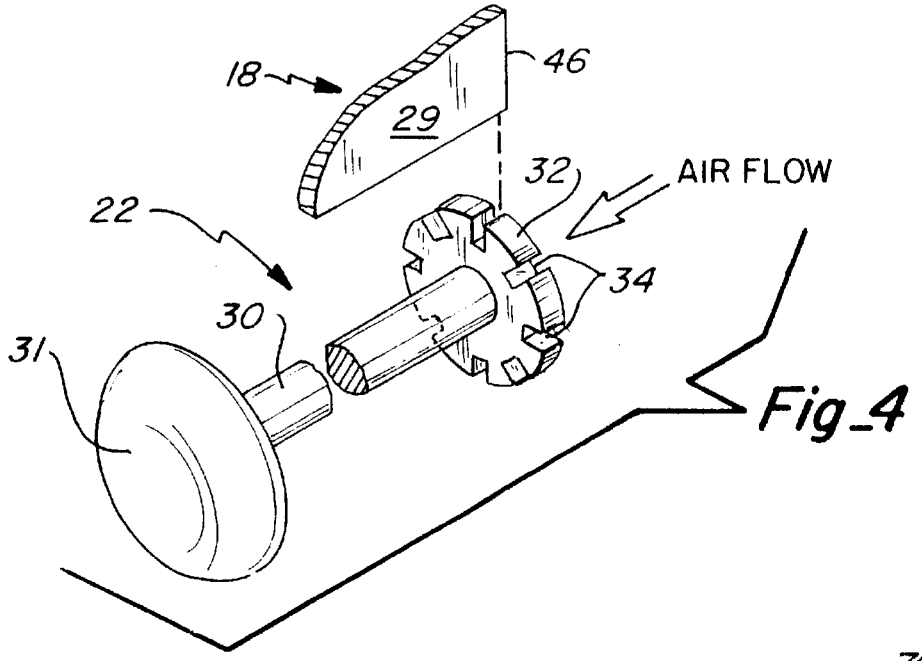
FIG. 4 is a greatly enlarged fragmentary perspective view of the hub of the air mixing apparatus, illustrating how the vanes of the air mixing apparatus attach to the hub.
Figure 8:
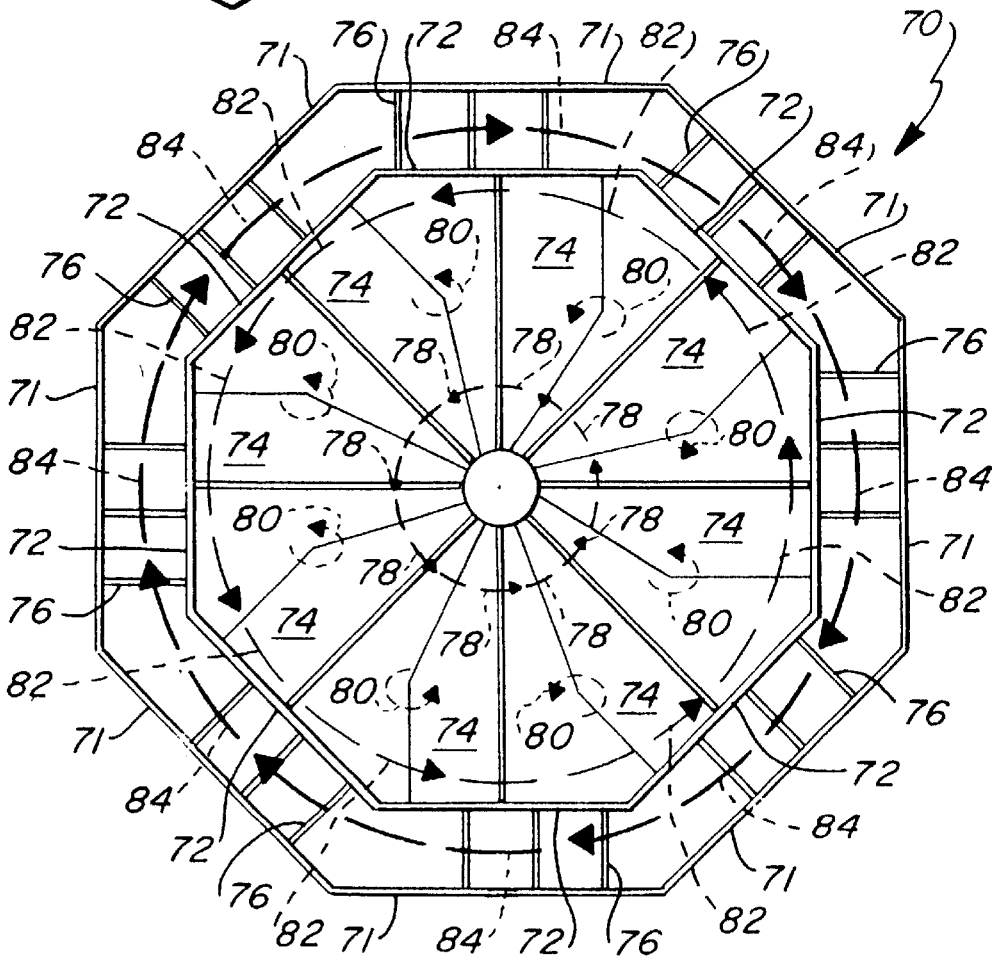
Fig 8 (PRIOR ART)
FIG. 8 is a rear elevation view of the air mixing apparatuses shown in U.S. Pat. Nos. 4,495,858; 5,645,481; and 5,336,207, and specifically illustrating the vortices which are created by the air mixing apparatuses of those inventions.

FIG. 4 illustrates one preferred way in which the vanes 16 may be attached at the central hub 22. As shown, the central hub 22 may include a rod 30 which interconnects a hub tab 31 and a slotted connector plate 32. The connector plate 32 includes a plurality of spaced slots 34, there being one slot each for a corresponding vane to be inserted therein. Accordingly, the most proximal or inner ends 46 of the vanes 18 are inserted within the corresponding slots 34.

Figure 5:
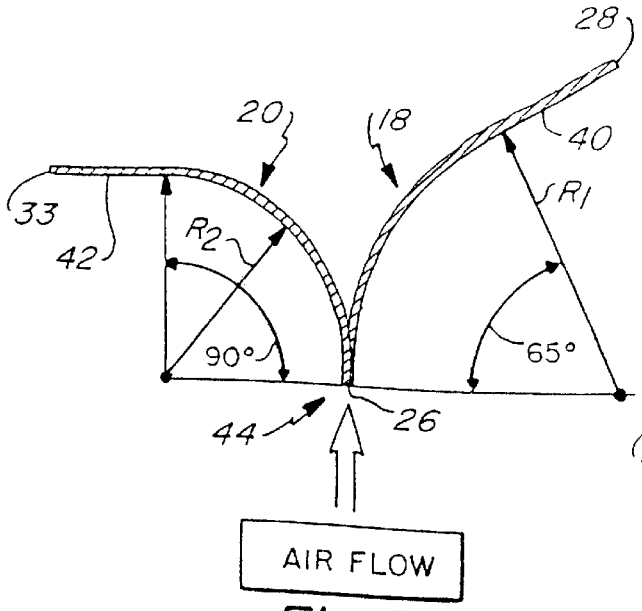
FIG. 5 is a cross sectional view of one of the vanes taken along line 5—5 of FIG. 1 specifically illustrating the interface or junction between the inner and outer sections of the vane which diverge away from one another in the downstream direction.

FIG. 5 illustrates a cross-section of a vane 18 taken along line 5—5 of FIG. 1, and the preferred angles at which the inner and outer sections diverge from one another. As measured from a center of curvature for the inner section 18, the curvature of the inner section further being defined as having a radius $R_1$, the preferred downstream angle or pitch for the inner section 18 is an angle of approximately 65°. For the outer section 20, a preferred angle of downstream curvature would be in the range of 65° to 90°, the curvature also being measured from a center point of curvature for the outer section, and having a radius shown as $R_2$. Although 65° and a range of 65° to 90° have been provided as preferable downstream pitch angles for the respective inner and outer sections, it shall be understood that the invention is not limited to the pitch angles and these angles can be modified to provide the desired downstream turbulence for mixing of the airstreams.

Figure 6:
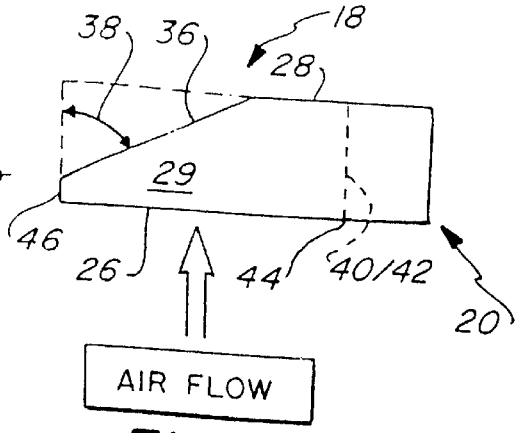
FIG. 6 illustrates the clip angle of a vane in accordance with the present invention as well as the construction of a vane from a single piece of material.

FIG. 6 illustrates how a vane 16 of the present invention can be cut from a singular rectangular piece of material. As shown, the inner section 18 is shaped by removal of a triangular portion of the material (shown in dotted lines) located at the proximal end 46. The angle at which the material is removed constitutes the clip angle, denoted by the angle subtended by arc 38. As discussed with respect to the previous patents of the assignee, the clip angle or relieved area thus constitutes a portion of the inner section of the blade having an inclined surface 36. The preferred method for determining a preferred clip angle is set forth by the following equation:

$$\text{Preferred clip angle} = 90 - 360/\text{number of blades}$$

Thus, for the preferred embodiment shown in the Figures, the clip angle would be:

$$\text{Preferred clip angle} = 90-360/8$$

$$= 45°.$$

Although a preferred method is set forth for determining a desirable clip angle, the invention herein shall not be interpreted as being limited to such a clip angle. Furthermore, the method sets forth a desirable approximation for the clip angle and small deviations to the calculation within a few degrees would still substantially confirm to an acceptable range.

In order to form the outer section 20 of the blade, the material can be cut along the dotted line denoted by line 40/42, the cut extending toward the connection point 44 between the inner and outer sections. Then, the desired curvature or pitch of the respective inner and outer sections can be provided by bending the inner and outer sections away from one another.

Figure 7:
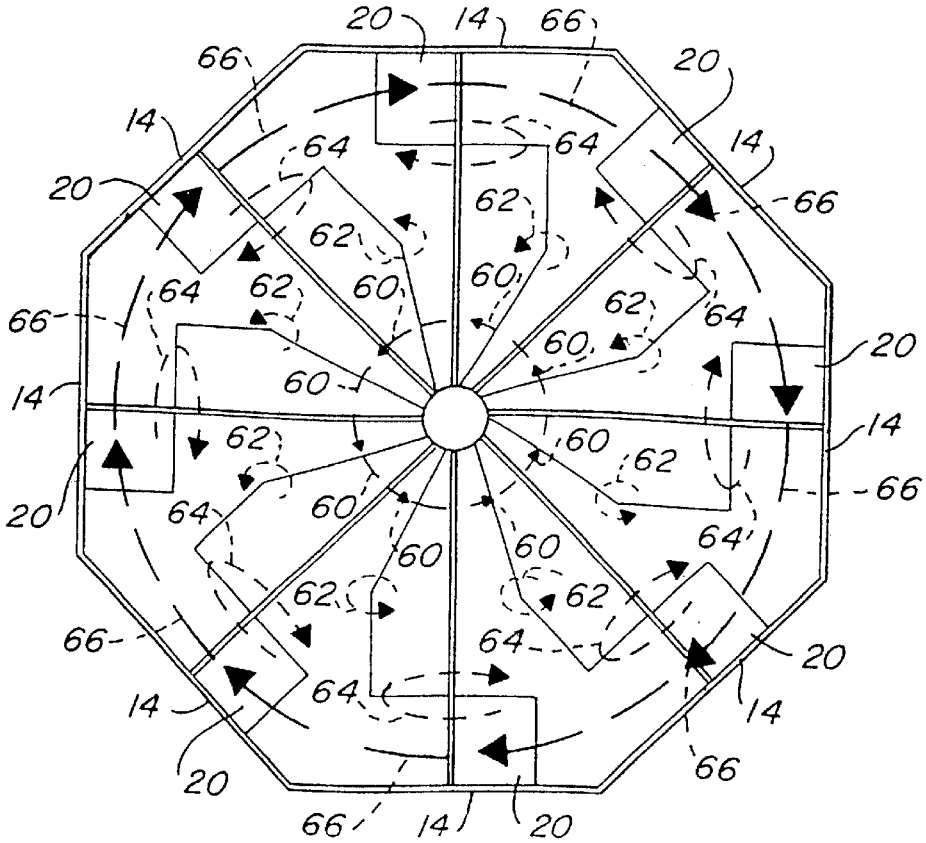
FIG. 7 is a rear elevation view of the air mixing apparatus of the present invention, specifically illustrating the various vortices which are created downstream of the air mixing apparatus as airstreams pass through the air mixing apparatus.

FIG. 7 is a rear elevation view of the air mixing apparatus of the present invention, viewing the air mixing apparatus from a downstream location. The directional arrows in FIG. 7 denote the various vortices which are created by the pattern of the vanes. As discussed above, it is desirable to create downstream turbulence from the air mixing apparatus in order to adequately intermix the airstreams. The vortices are the discrete patterns of air which are created in the airstreams as they pass through the air mixing apparatus. The vortices have circulation patterns of greater velocity as they exist closer to the air mixing apparatus. As the airstreams move downstream, the vortices patterns become more divergent and have slower velocities.

As shown in FIG. 7, the vortices patterns created include a central vortex 60 which primarily circulates in a counterclockwise and downstream direction. Each of the blades create a smaller clip angle vortex 62 which is located near the distal end of the inclined edge 36. As shown, these clip angle vortices 62 also generally circulate in a counterclockwise and downstream direction. Another set of vortices are created at the interface between the inner and outer sections. This group of vortices is shown as interface vortices 64. These vortices generally circulate in a clockwise and downstream direction, and the size of these vortices are generally larger than the vortices 62. Finally, an outer vortex 66 is created, the outer vortex circulating in a clockwise and downstream direction. Thus, from viewing the air mixing apparatus 10 from its center to the enclosure 14, there are four vortices patterns which are encountered, and which result in efficient mixing of the airstreams.

A comparison of the air mixing apparatus 10 of the present invention versus the air mixing apparatus 70 of the assignee's earlier inventions shows that the present invention is structurally simplified, yet still provides adequate air mixing. As disclosed in assignees earlier inventions, the structure of the air mixing apparatuses include an outer enclosure 71, an inner enclosure 72, a plurality of radially extending inner vanes 74, and a plurality of outer vanes 76 which are disposed between the inner and outer enclosures. Unlike the present invention, each of the outer vanes 76 are separated vane structures which are not connected to any corresponding inner vanes 74. Furthermore, the air mixture 70 includes an additional enclosure, namely the inner enclosure 72.

The vortices patterns created in the air mixing apparatus 70 includes a central vortex 78 and a plurality of clip angle vortices 80. Thus, both the present mixer design and the air mixing apparatus 70 both include similar central vortices and the plurality of clip angle vortices. However, the vortices patterns created radially outward of the clip angle vortices 80 in the air mixing apparatus 70 substantially differ from the vortices patterns created in the present mixer design. As shown, the air mixing apparatus 70 includes an intermediate vortex 82 which rotates in a counterclockwise and downstream direction, and an outer vortex 84 is created between the inner and outer enclosures, the outer vortex 84 circulating in a clockwise and downstream circulation pattern. Thus, the air mixing apparatus 70 has no interface vortices 64 like the present invention.

Because of the increased gap between the outer sections 20 in comparison to the gaps between the outer vanes 76 of the previous air mixer design, there is more airstream flow through the outer portions of the present mixer design. Additionally, since there is no inner enclosure in the present mixer design, removal of this partition or enclosure allows more flow of air from the outer portion of the mixer to the inner portion of the mixer. This increased airflow through the present mixer design reduces the amount of shear present in the airstream flows, and thus accounts not only for the lower pressure drop across the present mixer design, but also the incremental loss in efficiency. It has been found through testing that the present mixer design has approximately 80% of the pressure drop in comparison with the previous mixer design, and the effectiveness of the present mixer design is approximately 10% less than the previous mixer design. However in a comparison of the construction between the present mixer design and the apparatus shown as mixture 70, the present mixer design is substantially simpler, thus greatly reducing manufacturing and assembly costs. Of particular note is the decreased number of parts and required welds to assemble the mixer. In the present mixer design, the only required welds or connections are those located at the distal ends of the outer sections 20 which connect to the inner wall surfaces 17.

While the present invention has been described in its application to mixing of airstreams of different temperature, the present invention is conformable for use in virtually any application for mixing fluid streams to include air or gaseous streams, or even liquid streams. The fluid streams can be either composed of similar or dissimilar fluid components or concentrations of the components. Thus, the present invention has a wide range of applications.

It is therefore to be understood that while a preferred form of the invention has been set forth and described herein, various modifications and changes will become apparent to those skilled in the art without departing from the spirit and scope of the present invention as defined by the appended claims.

What is claimed is:

1. A static air mixing apparatus adapted for intermixing airstreams of different temperatures flowing through a common duct having walls defining a passageway, said apparatus comprising:

at least one enclosure partially traversing said passageway;

a plurality of radially extending vanes diverging away from a center of said enclosure and terminating at their outer distal ends adjacent to said enclosure, at least one vane of said plurality of vanes having an inner section traversing a first distance from the center, and an outer section connected to said inner section along a leading radial edge of said vane, said outer section traversing a remaining distance from the inner section to said enclosure, said inner section curving rearwardly in a first direction away from said leading radial edge, and said outer section curving rearwardly in a second direction away from said leading radial edge.

2. An apparatus, as claimed in claim 1, wherein:

said inner section of said at least one vane has an inclined edge defining a clip angle.

3. An apparatus, as claimed in claim 2, wherein:

said clip angle is disposed at an angle determined approximately by the following equation:

clip angle=90−360/number of blades.

4. An apparatus, as claimed in claim 1, wherein:

said inner section curves rearwardly at an angle of about 65°.

5. An apparatus, as claimed in claim 1, wherein:

said outer section curves rearwardly at an angle between about 65° to 90°.

6. An apparatus, as claimed in claim 1, wherein:

said enclosure has a plurality of wall surfaces arranged in facing relation to outer distal ends of said outer sections, and said outer distal ends being connected to corresponding facing wall surfaces.

7. An apparatus, as claimed in claim 1, wherein:

an interface vortex is created at the junction between each said inner section and said outer section as the airstreams pass through said apparatus.

8. An apparatus, as claimed in claim 1, wherein:

a plurality of vortices are created as the airstreams pass through said apparatus, the vortices including an interface vortex circulating at the junction between each said inner section and said outer section, a clip angle vortex circulating at a distal end of an inclined edge of each said inner section, an outer vortex circulating near each said distal end of said vanes, and an inner vortex circulating adjacent the center of the enclosure.

9. A static air mixing apparatus adapted for intermixing airstreams of different temperatures flowing through a common duct having walls defining a passageway, said apparatus comprising:

at least one enclosure partially traversing said passageway;

a plurality of radially extending vanes diverging away from a center of said enclosure and terminating at their outer distal ends adjacent said enclosure, at least one vane of said plurality of vanes including means for separating said vane into an inner section and an outer section, said inner section curving rearwardly in a first direction and said outer section curving rearwardly in a second direction.

10. An apparatus, as claimed in claim 9, wherein:

said inner section of said at least one vane has an inclined edge defining a clip angle.

11. An apparatus, as claimed in claim 9, wherein:

said inner section curves rearwardly at an angle of about 65°.

12. An apparatus, as claimed in claim 9, wherein:

said outer section curves rearwardly at an angle between about 65° to 90°.

13. An apparatus, as claimed in claim 9, wherein:

said enclosure has a plurality of wall surfaces arranged in facing relation to outer distal ends of said outer sections, and said outer distal ends being connected to corresponding facing wall surfaces.

14. An apparatus, as claimed in claim 9, wherein:

an interface vortex is created at the junction between each said inner section and said outer section as the airstreams pass through said apparatus.

15. An apparatus, as claimed in claim 9, wherein:

a plurality of vortices are created as the airstreams pass through said apparatus, the vortices including an interface vortex circulating at a junction between each said inner section and said outer section, a clip angle vortex circulating at a distal end of an inclined edge of each said inner section, an outer vortex circulating near each said distal end of said vanes, and an inner vortex circulating adjacent the center of the enclosure.

16. A method of mixing airstreams of different temperatures flowing through a common duct having walls defining a passageway, said method comprising the steps of:

providing at least one enclosure traversing at least partially across said passageway;

positioning a plurality of radially extending vanes diverging away from a center of said enclosure and terminating at their outer distal ends adjacent said enclosure;

arranging at least one vane of said plurality of vanes to include an inner section curving rearwardly in a first direction, and an outer section connected to said inner section, said outer section curving rearwardly in a second direction, and said inner and outer sections having a common leading edge;

providing a flow of the airstreams through said plurality of vanes; and creating an interface vortex circulating near a junction between the inner and outer sections, said interface vortex contributing to mixture of the airstreams.

17. A method, as claimed in claim 16, further comprising the step of:

providing a plurality of the at least one vane, and creating a corresponding plurality of interface vortices.

18. A method, as claimed in claim 16, further comprising the step of:

arranging said at least one vane to include an inclined edge, and creating a clip angle vortex circulating at a distal end of the inclined edge.

19. A method, as claimed in claim 16, further comprising the step of:

providing a plurality of the at least one vane spaced from one another within the enclosure, and creating an outer vortex circulating near said distal ends of said vanes.

20. A method, as claimed in claim 16, further comprising the step of:

providing a plurality of the at least one vane spaced from one another within the enclosure, and creating an inner vortex circulating adjacent the center of the enclosure.

21. A method of manufacturing an air mixing apparatus adapted for intermixing airstreams of different temperatures flowing through the air mixing apparatus, said method comprising the steps of:

(a) providing an elongate strip of first material having a rectangular configuration, and bending the strip into the shape of an enclosure and connecting opposite ends of the first material;

(b) providing a piece of second material;

(c) cutting a triangular portion away from the piece of second material forming an inclined edge on the second piece of material;

(d) cutting a transverse slot in the second piece of material;

(e) bending the portion of the second material lying on one side of the slot to create a curved shape which curves in a first direction;

(f) bending the remaining portion of the second piece of material which lies on the opposite side of the slot to create a curved shape which curves in a second direction away from the first direction, the second piece of material bended in the first and second directions thereby forming a vane;

(g) mounting the vane in the enclosure so that the vane extends radially outward from a center of the enclosure;

(h) repeating steps (b)–(g) to emplace a desired number of vanes in the enclosure.

* * * * *